United States Patent [19]

Warfield et al.

[11] Patent Number: 4,736,761

[45] Date of Patent: Apr. 12, 1988

[54] UMBRELLA

[75] Inventors: James R. Warfield, 437 Madison, Fort Wayne, Ind. 46800; Kendall S. Smith, II, West Lafayette, Ind.; Robert J. Kennedy, Jr., West Lafayette, Ind.; Gregory N. Brown, West Lafayette, Ind.; Jeffrey L. Beaver, Indianapolis, Ind.

[73] Assignee: James R. Warfield, Ft. Wayne, Ind.

[21] Appl. No.: 316,116

[22] Filed: Oct. 29, 1981

[51] Int. Cl.[4] ..... A45B 11/0; A45B 17/0; A45B 23/0; A45B 35/0

[52] U.S. Cl. ..... 135/20 R; 135/22; 135/24; 135/29

[58] Field of Search ..... 135/20 R, 22, 24

[56] References Cited

U.S. PATENT DOCUMENTS 2,864,389 12/1958 Smith ..... 135/20 R X
3,020,555 2/1962 Taylor ..... 135/22 X
3,467,114 9/1969 McSherry ..... 135/20 R X
4,023,582 5/1977 Buzzella ..... 135/20 R
4,240,454 12/1980 Tsai ..... 135/24

FOREIGN PATENT DOCUMENTS 231634 2/1964 Austria ..... 135/20 R

*Primary Examiner*—Anton O. Oechsle
*Assistant Examiner*—Mark S. Graham
*Attorney, Agent, or Firm*—Lundy and Walker

[57] ABSTRACT

First and second elongated coaxial tubular members are slidably related for relative longitudinal movement. The first member carries a cylindrically shaped pivot block to which are pivoted a plurality of circumferentially spaced pivot pieces, for pivotal movement towards and away from the first member. A collapsible umbrella canopy supporting rib extends from each of such pieces. A cup shaped member is attached to the second member and operates simultaneously against the pieces to move them away from the first member and extend the ribs outwardly in canopy supporting position upon relative longitudinal movement of the members.

18 Claims, 3 Drawing Sheets

UMBRELLA

BACKGROUND OF THE INVENTION

This invention is in the field of weather protecting collapsible umbrellas having a canopy supported by a plurality of pivotable ribs swingable towards and away from the umbrella shaft.

Umbrellas for weather protection have long been used. The typical construction comprises a plurality of arcuate ribs, each attached intermediately of its length to one end of a spoke, the other spoke end being pivotally attached to a manually slidable sleeve on the umbrella shaft. Sliding the sleeve upwardly on the shaft moves the spokes against the ribs to extend them to a canopy supporting position. The length of sleeve travel required and the amount of sleeve moving force limits the practical operating linkages that are usable. Also, the number of parts required in the conventional umbrella results in undesirably high manufacturing costs and higher liklihood of umbrella malfunction and breakage.

It is therefore desirable to provide an improved weather protecting collapsible umbrella having less parts and therefore being substantially less complex, more economical to manufacture than conventional umbrellas and is yet durable in use.

SUMMARY OF THE INVENTION

Therefore, it is a primary object of this invention to provide an improved weather protecting umbrella apparatus.

It is another object of this invention to provide an improved weather protecting collapsible umbrella apparatus having fewer parts than conventional umbrellas.

It is another object to provide an improved weather protecting collapsible umbrella apparatus which is more economical to manufacture than conventional umbrella apparatus.

Another object of this invention is to provide an improved weather protecting collapsible umbrella apparatus that is more durable in use and less likely of umbrella malfunction and breakage than conventional umbrella apparatus.

Another object of this invention is to provide an improved weather protecting collapsible umbella apparatus having opening and closing mechanism having a shorter length of travel than the opening and closing mechanisms of conventional umbrella apparatus.

Finally, it is another object of this invention to provide an improved umbrella apparatus meeting all of the above-identified objects.

In the broader aspects of this invention there is provided an improved weather protecting umbrella apparatus having first and second elongated coaxial tubular members that are slidably related for relative longitudinal movement. The first member carries a cylindrically shaped pivot block to which are pivoted a plurality of circumferentially spaced pivot pieces, for pivotal movement towards and away from the first member. A collapsible umbrella canopy supporting rib extends from each or such pieces. A cup shaped member is attached to the second member and operates simultaneously against the pieces to move them away from the first member and extend the ribs outwardly in a canopy supporting position upon relative longitudinal movement of the members.

BRIEF DESCRIPTION OF THE DRAWINGS

The above mentioned and other features and objects of this invention and the manner of attaining them will become more apparent and the invention itself will be best understood by reference to the following description of an embodiment of the invention taken in conjunction with the accompanying drawings, wherein.

DESCRIPTION OF A SPECIFIC EMBODIMENT

Figures 1, 2:
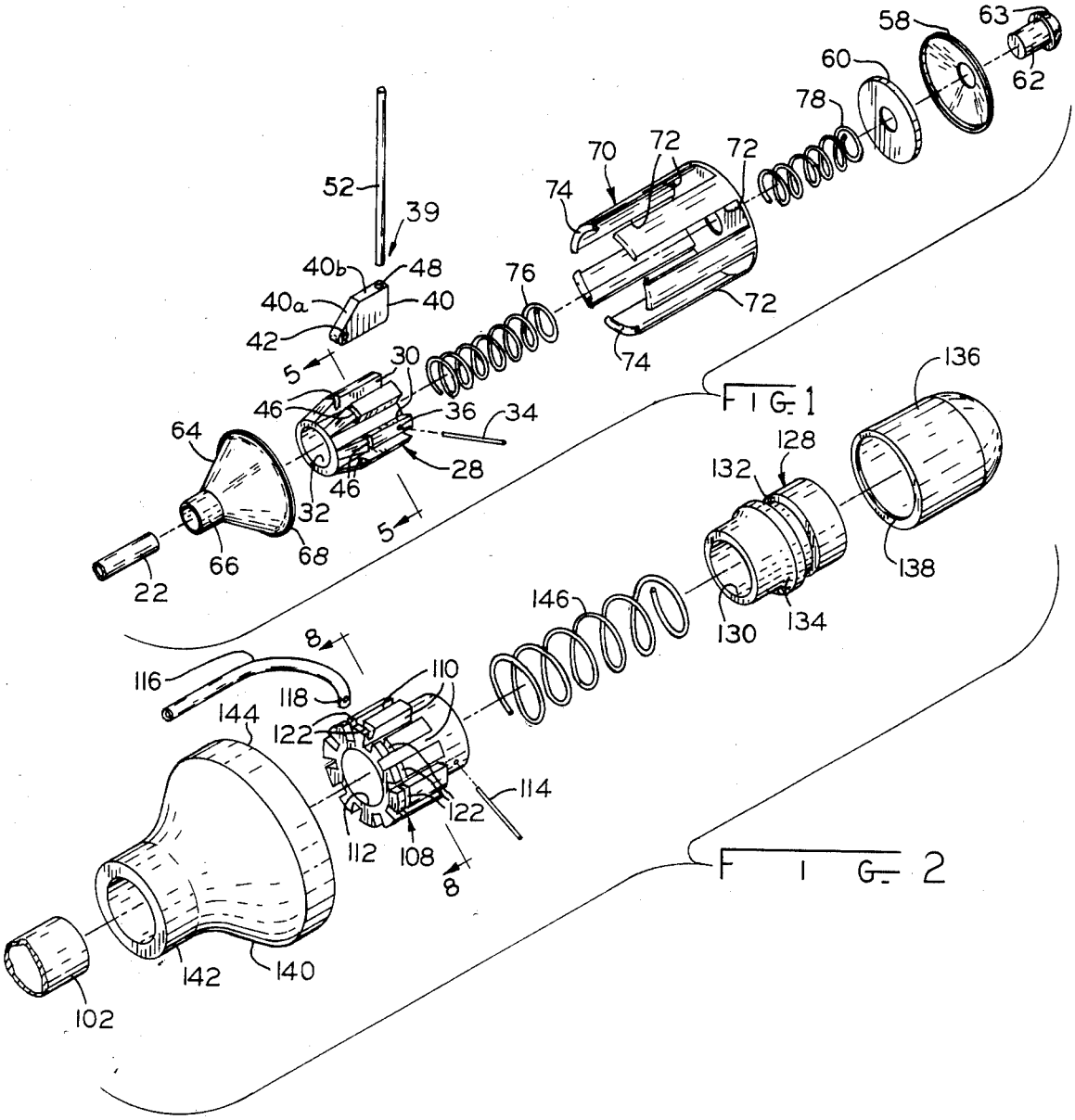
FIG. 1 is an exploded view in perspective of the improved weather protectin umbrella apparatus of this invention.
FIG. 2 is an exploded view in perspective of a modified version of the improved weather protecting umbrella apparatus of this invention.

Referring to FIGS. 1, 3–5, an umbrella 20 has an inner first tubular elongated member 22 that is inserted into an outer tubular elongated second member 24 and longitudinally slidable therein. A handle 26 is affixed to the lower end of member 22 for manual grasping of the umbrella. A cylindrical pivot block 28, having a tapered lower end, has five longitudinal slots 30 formed in the outer wall thereof and has a central opening 32 into which member 22 is inserted. Pin 34, FIG. 1, is inserted into diametral hole 36 in block 28, through holes in member 22 and into an opposite diametral hole in block 28 to secure member 22 to block 28 and restrain relative longitudinal and rotative motion between member 22 and block 28.

A plurality of rib assemblies 39 are provided to support canopy 56. Each rib assembly 39 includes a pivot piece or wing 40 and a rib 52. Each wind 40 has a polygonal configuration and has a pivot hole 42 formed in a corner thereof which receives a pivot pin 44. Circumferential grooves 46, FIG. 1, are formed in block 28 near its lower end for receiving pins 44. A wing 40 is pivotally mounted in each slot 30 by pins 44 being frictionally held in grooves 46 at the opposite ends thereof. Each wing 40 has edges 40*a*, 40*b* and has a rib socket 48 for tightly receiving the inner end of a lightweight canopy supporting rib 52. The outer end of rib 52 has a tip cap 54 fitted thereover to hold a canopy edge portion thereto.

A canopy 56 is circular in configuration and has a central opening, the inner edge of which is perimetrically clamped between grommet 58 and annular disk 60 which fits snugly into a circumferential lip of grommet 58 and frictionally held in place. The outer edge of canopy 56 is attached at equally spaced circumferential points to the respective outer ends of the five ribs 52 by tip caps 54. Canopy 56 is of a collapsible weather resistant material of a kind well known in the art. Grommet 58 and disk 60 as a unit are slidable on member 22. A resilient cylindrical plug 62 is secured to member 22 by being forcefully inserted into the upper open end of member 22 and has a crown 63 extending beyond the outer diameter of member 22.

A cup 64 has a central opening from which a cylindrical flange 66 depends defining an opening into which the upper end of member 24 is forcefully inserted securing cut 64 to member 24. Cup 64 has an outwardly flared wall bounded by rim 68 which is rolled over outwardly to form an inverted perimetral trough. In this embodiment, the flare angle is about 45°.

A cylindrical cap 70 has five longitudinal slots 72 formed in the side walls thereof and are equally spaced about the circumference thereof. Slots 72 are of sufficient circumferential dimension to allow free pivoting of wings 40 therethrough. The lower slotted perimeter 74 of cap 70 is rolled over inwardly to form a plurality of troughs that mate with the cup trough and are crimped, bonded or otherwise firmly attached thereto to secure cap 70 to cup 64.

A relatively heavy compression spring 76 encircles member 22 at its upper end between block 28 and the underside of the top of cap 70. A relatively light compression spring 78 encircles member 22 near the upper end thereof between the top of cap 70 and the underside of disk 60. In a preferred embodiment, spring 76 exerts a 10 lb. force and spring 78 exerts a 3 lb. force, resulting in a net upward force on the top of cap 70.

The lower end of member 24 has a flange 80. A catch 82 has an arcuate upper surface and is pivoted at pivot 84 to handle 26 and has protrusion 86 extending laterally therefrom. Coil spring 88 urges protrusion 86 outwardly.

Figures 3, 4, 5:
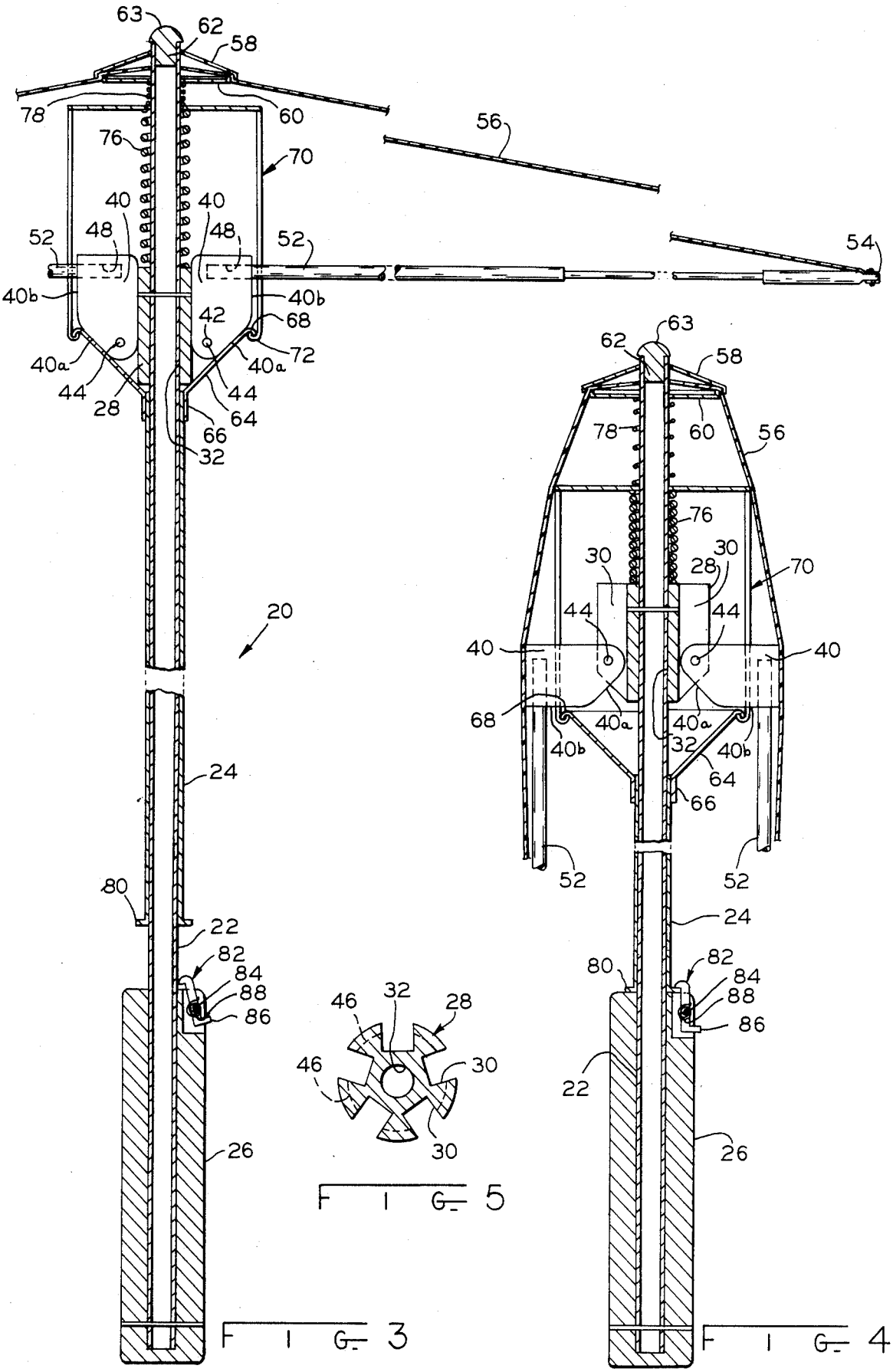
FIG. 3 is a partial, broken, sectioned view of the improved weather protecting umbrella apparatus illustrated in FIG. 1 in the open positon.
FIG. 4 is a view similiar to FIG. 3 but in the closed position.
FIG. 5 is a section taken at 5—5 of FIG. 1.

Referring in particular to FIGS. 3, 4, which show respectively the open and closed umbrella positions, the operation of this embodiment will be described. In the closed position, FIG. 4, catch 82 has engaged flange 80 and is holding it and member 24 against the net upward force of springs 76, 78. Upon manual pushing of protrusion 86, flange 80 will be released and member 24 will slide upwardly on member 22. Rim 68 acts against edges 40*b* of wings 40, pivoting them upwardly towards member 22. Continued upward movement of member 24 causes rim 68 to engage and act against edges 40*a* and to continue the outward and upward swinging of wings 40 until the wall of flared cup 64 engages edges 40*a*, FIG. 3. At this time the umbrella is in the open position and the wings 40 are nested in cup 64, edge 40*a* being supported along its length by the flared cup wall. During the opening movement, spring 76 becomes partially decompressed, and spring 78 becomes partially compressed making canopy 56 taut. The overhang of crown 63 maintains gromet 58 and disk 60 on member 22.

During opening movement, wings 40 and ribs 52 are pivoted outwardly to fully extend canopy 56 to a weather protecting cover. The relative dimensional movement between members 22, 24 between the open and closed positions is substantially less than that for conventional umbrellas.

In the closing movement, wings 40 pivot downwardly away from member 22, collapsing canopy 56 towards the sides of member 24. The tip caps 54 or the ribs 52 may then be releasably held in a conventional manner to prevent loose movement of ribs 52.

Referring now to FIGS. 2, 6–8, a modified version of umbrella 100, will be described. As in the previous embodiment, an inner elongated tubular first member 102 is inserted into an outer elongated tubular member 104 and is slidably movable relative thereto in a longitudinal direction. A handle 106 is affixed to the lower end of member 102 for manual grasping of the umbrella. A cylindrical pivot block 108 has ten longitudinal slots 110 formed in the outer wall thereof and has a central opening 112 into which member 102 is inserted and is secured thereto against relative longitudinal and rotative motion by pin 114, inserted into holes in block 108 and member 102 in the manner of pin 34 insertion in block 28 and member 22.

A pivot piece or arcuate arm 116, has a transverse pivot hole 118 formed at one end thereof which receives a pivot pin 120. An arm 116 is pivotally mounted in each slot 110. Circumferential grooves 122 are formed at the lower end of block 108 for frictionally receiving pins 120 in a manner similiar to grooves 46 receiving pins 44. Each arm 116 has a rib socket 124 for tightly receiving the inner end of an elongated lightweight canopy supporting rib 126. The outer ends of ribs 126 are provided with tip caps 54 for securing a portion of the outer circumference of a generally circular canopy 127 to ribs 126. The canopy may be similiar in configuration and material to canopy 56.

Annular collar 128 has a bore 130 for slidably receiving the upper end of member 102. A circumferential groove 132 is formed in the outer wall of collar 128 intermediately thereof. Collar 128 has an annular outer shoulder 134 formed near the lower end thereof. A resilient cap 136 has an annular lip 138 formed at its lower periphery on the inner wall thereof which snaps into groove 132 over the inner perimetral edge of canopy 127 to secure it to collar 128.

A cup 140 has a central opening from which a cylindrical flange 142 depends. Flange 142 receives and is affixed to, as by a force fit or bonding, the upper end of member 104. Cup 140 has an outwardly flared side wall and a rim 144, which has a surface shaped to the curvature of arms 116 to provide a surface support to each of the arms 116 when the umbrella is in the open position, FIG. 6.

A compression spring 146 encircles member 102 and acts between shoulder 134 and block 108 to maintain canopy 127 taut. A longitudinal slot is formed in the wall of member 102 just above handle 106 to receive spring loaded lever 148 which protudes therefrom to support the lower edge of tube 104 when the umbrella is in the open position, FIG. 6.

Figures 6, 7, 8:
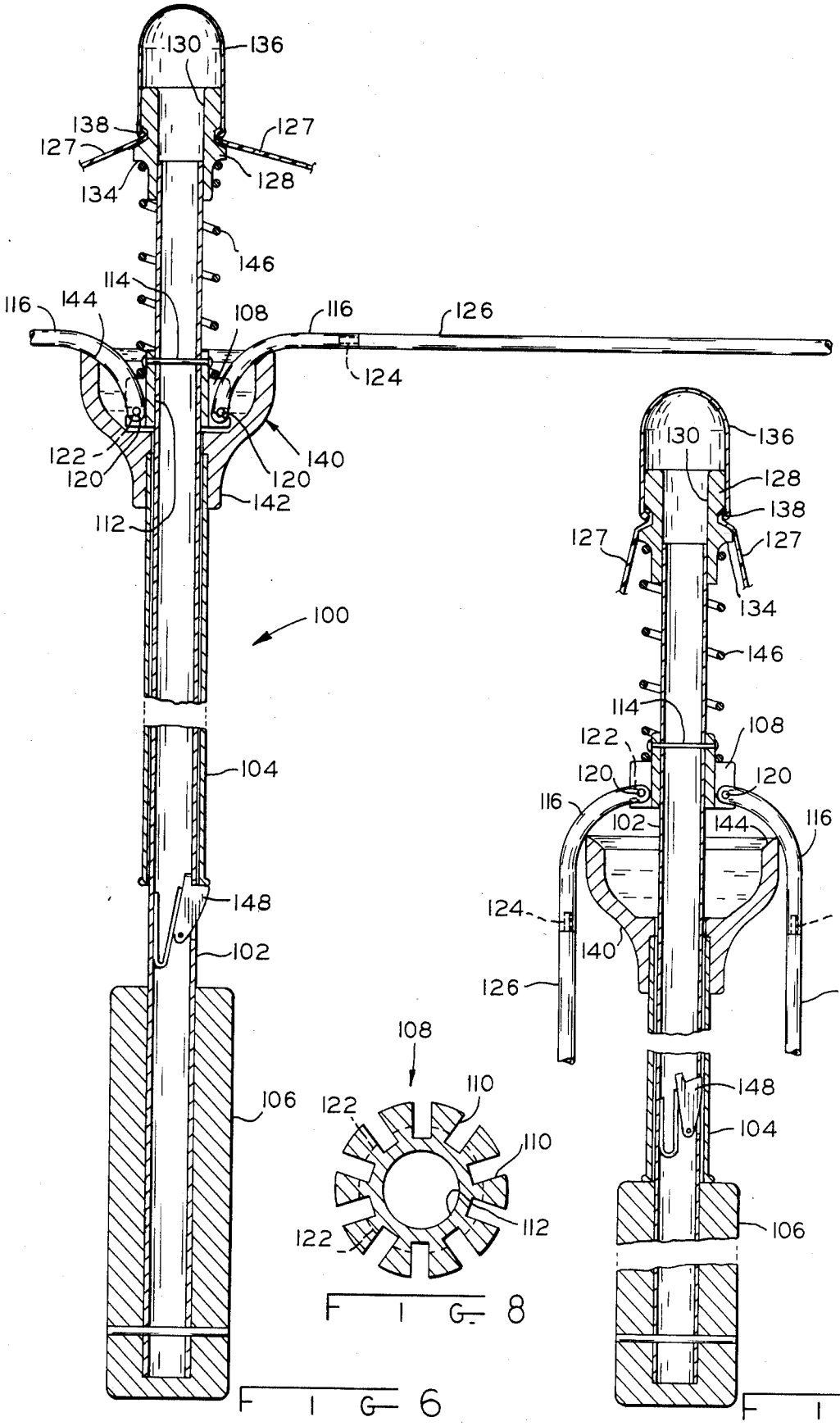
FIG. 6 is a partial, broken, sectioned view of the modified version of the improved weather protecting umbrella apparatus of the invention illustrated in FIG. 2 in the open position.
FIG. 7 is a view similiar to FIG. 6 but in the closed position.
FIG. 8 is a section taken at 8—8 of FIG. 2.

Referring to FIGS. 6, 7, the operation of the second embodiment will be described. In the closed position, FIG. 7, the lower peripheral edge of member 104 seats on the top portion of handle 106 and arms 116 are in the lowered position. Spring 146 is partially decompressed and lever 148 is pivoted inwardly within member 102. Upon sliding member 104 upwardly on member 102, rim 144 rides upwardly against the underside of the curved portion of all arms 116 simultaneously, causing arms 116 to swing outwardly, away from member 102. After a longitudinal travel of about 0.75 inches, the umbrella is open, FIG. 6, and lever 148 is spring urged outwardly in raised position support of member 104 on member 102. Spring 146 has been partially compressed and ribs 126 are extended radially outwardly from member 102. To lower the umbrella, lever 148 is pushed inwardly until it clears the lower end of member 104, allowing it to slide downwardly under the weight of the umbrella components and force of spring 146.

Due to the very short travel of member 104 relative member 102 between closed and open positions, a mechanical screw drive may be incorporated between members 102 and 104 so that upon relatively few turns of rotational movement therebetween, the umbrella may be raised. This has the advantage of maintaining the umbrella in the open position without a lever or latch. Also, a worm gear, rack and pinion, as well as highly pitched threads may be used to impart sliding movement between members 102, 104. Also, a small battery driven electric motor may be used for this purpose.

Further, a manufactured umbrella 100 would have a total of 43 pieces vs. 91 pieces for a typical conventional umbrella, a reduction of 52.7%, resulting in a corresponding savings in labor and materials in manufacture. Also, because of the fewer parts used, and improved sturdiness of the parts, the umbrella of this invention is more durable.

While there have been described above the principles of this invention in connection with specific embodiments, it is to be understood that this is by way of example and is not limiting of the scope of this invention.

What is claimed is:

1. An umbrella apparatus comprising first and second members, said second member having upper and lower ends, said members being movable relative to each other; a plurality of canopy supporting assemblies, each of said rib assemblies being secured at one end to said first member and pivotable toward and away from said first member, said rib assemblies being swung inwardly toward said first member when said rib assemblies are pivoted to a first position, said ribs being swung outwardly away from said first member when said rib assemblies are pivoted to a second position; a cup having a central lower opening defined by an opening perimeter and a central upper opening defined by a cup opening rim, said cup having a sidewall extending between said perimeter and said rim, said cup being secured to the upper end of said second member at said opening perimeter, said side wall of said cup being flared outwardly from said second member to said cup rim, said rim being engagable substantially simultaneously with said rib assemblies as said second member moves relative to said first member to pivot said ribs toward and away from said first member.

2. The apparatus of claim 1 wherein said second member is tubular and said first member is slidable therewithin.

3. The apparatus of claim 1 including a handle affixed to the lower end of said first member.

4. The apparatus of claim 1 wherein said first and second members are elongated; said second member being tubular and said first member being slidable therewithin.

5. The apparatus of claim 1 further comprising a weather protecting collapsible canopy being centrally attached to the upper end of said first member and being attached at portions adjacent its perimeter rib assemblies; said canopy forming a protected cover when said rib assemblies are in said second position, and being collapsed along said first and second members when said rib assemblies are in said first position.

6. The apparatus of claim 1 wherein said first member further comprises a pivot block carried by said first member adjacent the upper end thereof, and said canopy supporting rib assemblies further comprise a plurality of pivot pieces pivotably mounted to said block and pivotable toward and away from said first member said rib assemblies comprising a rib and a pivot piece, each of said ribs being secured at one end to a respective pivot piece.

7. The apparatus of claim 6 wherein each of said pivot pieces has a planar polygonal configuration, each of said pieces being pivotally connected adjacent one corner thereof to said pivot block, one edge of each of said pieces lying along and being supported by said cup when said pieces are in said second position.

8. The apparatus of claim 7 wherein the flare angle of said side wall of said cup is approximately 45°.

9. The apparatus of claim 7 wherein each of said pieces has a second edge supported on said rim when said pieces are in said first position.

10. The apparatus of claim 9 wherein each of said second edges is approximately horizontal and lies along a diameter of said rim when said pieces are in said first position.

11. The apparatus of claim 6 wherein there are five of said pieces.

12. The apparatus of claim 6 wherein said block is annular and has a central opening to receive said first member;

means to secure said block to said first member against longitudinal movement relative thereto;

a plurality of circumferentially spaced longitudinal slots being formed in the outer wall of said block;

a said piece being pivotally attached to pivot in and out of each of said slots.

13. The apparatus of claim 6 including a retaining cap having an opening in its top surface through which said first member is slidably inserted;

the lower perimeter of said cap being firmly attached to said rim to form a block chamber between said cap and said cup;

said block being longitudinally movable within said chamber;

a spring mounted on said first member between the top surface of said cap and said block to urge said block in a downward direction towards said cup.

14. The apparatus of claim 13 including a circular canopy clamp for centrally clamping a canopy; said clamp being slidably mounted to said first member adjacent the top end thereof;

a second spring being between said clamp and the top of said cap to urge said clamp upwardly on said first member and to make said canopy taut.

15. The apparatus of claim 14 including releasable latch means for releasably latching said first and second members against relative longitudinal movement when said pieces are in said first position.

16. The apparatus of claim 6 including a canopy collar slidably mounted to the upper end of said first member for attachment centrally of a weather protection collapsible canopy;

spring being between said collar and said block to urge said collar upwardly relative to said first member to provide canopy tautness and urge said to rib assemblies to their second position.

17. The apparatus of claim 1 further comprising yieldable holding means for yieldably holding said rib in said second position.

18. The apparatus of claim 17 wherein said yieldable holding means comprises a spring mounted on said first member and acting on said block for urging said block in a direction to pivot said rib assemblies into said second position.

* * * * *